United States Patent [19]

Jury

[11] 4,257,251

[45] Mar. 24, 1981

[54] METAL FORMING PROCESS

[75] Inventor: Harold R. Jury, Glynde, Australia

[73] Assignee: Flight Furniture Pty. Ltd., Glynde, Australia

[21] Appl. No.: 24,404

[22] Filed: Mar. 27, 1979

[30] Foreign Application Priority Data

Mar. 30, 1978 [AU] Australia ..... PD3830
Sep. 11, 1978 [AU] Australia ..... PD5889

[51] Int. Cl.[3] ..... B21D 22/10

[52] U.S. Cl. ..... 72/57; 72/184; 72/465; 72/DIG. 14

[58] Field of Search ..... 72/57, 60, 184, 172, 72/207, 465, DIG. 14, 244, 63

[56] References Cited

U.S. PATENT DOCUMENTS

| | | | |
|---|---|---|---|
| 1,614,425 | 1/1927 | Coe | 72/244 |
| 1,741,405 | 12/1929 | Coe | 72/244 |
| 2,150,416 | 3/1939 | Cairns | 72/207 |
| 2,366,487 | 1/1945 | Burgess | 72/60 |
| 3,415,095 | 12/1968 | Bringewald | 72/172 |
| 3,971,243 | 7/1976 | Jones | 72/63 |

*Primary Examiner*—Lowell A. Larson
*Attorney, Agent, or Firm*—Norbert P. Holler; Stuart E. Krieger

[57] ABSTRACT

A sheet metal workpiece is deformed by embossing or shearing over a patterned die plate, by placing the workpiece on the die plate, a slab of rubber or other elastomer on the workpiece, and passing between spaced parallel driven rollers.

A characteristic of the invention is the use of load rollers adjacent and on each side of the lower roller to support a carriage which itself supports the die plate so that the resilient forces imposed by the rubber do not curve the carriage and die plate.

13 Claims, 11 Drawing Figures

METAL FORMING PROCESS

This invention relates to a process for deforming a workpiece (for example of flat sheet metal) to conform to a pattern on a surface of a die plate and to a machine for effecting said process.

BACKGROUND OF THE INVENTION

The processes for the forming of sheet metal currently include the brake press forming of fold lines (or folding about fold lines with a folding machine), roll forming, or pressing either between two dies, one of which is male and the other female, or alternatively, pressing with a female die and rubber contained in a container to function as a semi-fluid and effect the pressing.

Roll forming and brake pressing is usually limited to the formation of constant cross-sectional shape articles, although it is known to have serrated or otherwise formed rollers on roll forming machines for effecting transverse as well as longitudinal deformation of the workpiece. Simple serrated rollers are relatively inexpensive, but rollers having more complex patterns thereon, for example, to provide a checker-plate effect, are very expensive and for this reason are not commonly used. As indicated in U.S. Pat. Nos. 2,280,359 TRUDELL and 2,966,873 HOFFMAN, it is known to press sheet metal against rubber in a large press, but many practical problems are encountered because of the huge presses required. For example, to press a two meter by one meter sheet of metal to a checker-plate configuration utilising the rubber male die technique would require a press of approximately 12000 ton capacity, a very large slab of rubber, and a container for containing the rubber around its edges when it functions as a semi-fluid during the pressing operation.

In the U.S. Pat. No. 2,528,540 OLDOFREDI there are described and illustrated two methods of ornamenting sheet metal, one of which incorporates a slab of rubber in a press and the other a rubber coated roller. The press arrangement is subject to the abovementioned disability of high pressure requirement, and experiments conducted by the inventor herein have established that a rubber covered roller is subject to the very serious disability that the peripheral length of the rubber greatly increases when high pressure applied against a workpiece reduces the radial thickness of the rubber at that point.

The closest prior art known to the inventor is the abandoned Australian application No. 43127/64 in the name of John Lysaght (Australia) Limited, wherein one embodiment suggested the use of a die sheet on which was placed a workpiece and a slab of cushioning material, the "sandwich" being passed between driven rollers, and supported front and rear on idler rollers of respective roll cases. Experiments have indicated that this process is suitable for embossing. thin sheet metal workpieces. It does not appear to be suitable for embossing or shearing thick metal workpieces (say above 0.040 inches or 1 mm. thickness), since the bending loads applied to a relatively unsupported die plate and carriage by the elastomer in front of and to the rear of the nip of the rollers impose such a heavy load that, either the die plate and carriage will bend, or the die plate and carriage will be of such size and weight that only low production rates will be achieved.

The main object of this invention is to provide a simple process and machine for the forming of sheet metal wherein transverse as well as longitudinal deformations may be effected, not only in very thin sheet metal, but in metal of a thickness which is useful for a wide range of applications, for example, in thicknesses greater than 0.020 inches or 0.5 mm.

BRIEF SUMMARY OF THE INVENTION

A sheet metal workpiece is deformed by embossing or shearing over a patterned die plate, by placing the workpiece on the die plate, a slab or rubber or other elastomer on the workpiece, and passing between spaced parallel driven rollers.

A characteristic of the invention is the use of load rollers adjacent and on each side of the lower roller to support a carriage which itself supports the die plate so that the resilient forces imposed by the rubber do not curve the carriage and die plate. The invention is capable of shearing or embossing relatively thick plates.

Specifically, the process of the invention comprises loading the die plate onto a carriage in a machine having a first pressing roller, a second pressing roller, a front load roller and a rear load roller respectively in front of and to the rear of, and both adjacent the second pressing roller and having their rolling surfaces cooperating with the rolling surface of the second pressing roller to define a carriage support plane, all said rollers having parallel axes of rotation, positioning the workpiece with one surface thereof contiguous with said pattern surface of the die plate, positioning a slab of elastomeric material with one surface thereof contiguous with another surface of said workpiece, driving all said rollers simultaneously, and feeding the sandwich of said slab, workpiece and die plate, firstly over the front load roller, into the nip of the pressing rollers and then over the rear load roller, thereby supporting the carriage and die plate against deformation while at the same time deforming the workpiece on the pattern plate by plastic flow of the elastomeric slab.

Contrary to expectation it has been discovered that a workpiece can be formed to have a desirable pattern with a total loading of about 200 tons, whereas the same workpiece could not be pressed in a press to the same pattern if the press was less than 120000 tons capacity. The cost of the tooling is relatively low, and the sheet metal will faithfully reproduce the embossment pattern of the pattern plate. Although the pattern plate is described as being on the bottom of the sandwich, the sandwich can be reversed so as to have the rubber on the bottom and the pattern plate on top, and in such an instance the rubber can, for example, be an endless belt which carries the workpiece and pattern plate through with it as it is driven between the rollers.

The invention extends also to the product of the process, and in one application of the invention there is provided a sheet of metal having its surface deformed to provide a quilted effect by the process referred to above. In another application there is provided a checker-plate effect, in a third application there is provided a laminate of two metals one of which is sheet metal formed by the process and the other a relatively heavy back-up sheet. There are of course, many other applications, for example, metal sheets which contain perforations formed by the process and products such as footpath drain covers, sun screens, furniture panels, flooring panels and the like which result from this process.

The process of this invention simplifies the production of small runs since die change-over is very simple and inexpensive. The die costs are relatively small, and the process can be used to duplicate a surface configuration of a steel plate for example. The process may be used to form or shear sheet metal. The process may be used in lieu of a roll forming process with the additional advantage of deforming transversely of direction of workpiece travel. Damage to the surface can be reduced to a minimum because of the use of rubber which is relatively soft compared with the metal surface even if the metal is aluminium. The metal can, if desired, be coated with an enamel which is partly removed from the surface at the locality of heavily stained areas, thereby providing a two-tone colour for the surface. The product can be formed to have downturned flanges simultaneously as the surface configuration is rolled. There are numerous other products and advantages which will become evident hereunder.

BRIEF DESCRIPTION OF THE DRAWINGS

While the invention need not necessarily be limited to the abovementioned details, embodiments are described hereunder in further detail with reference to and are illustrated in the accompanying drawings, in which.

Figure 1:
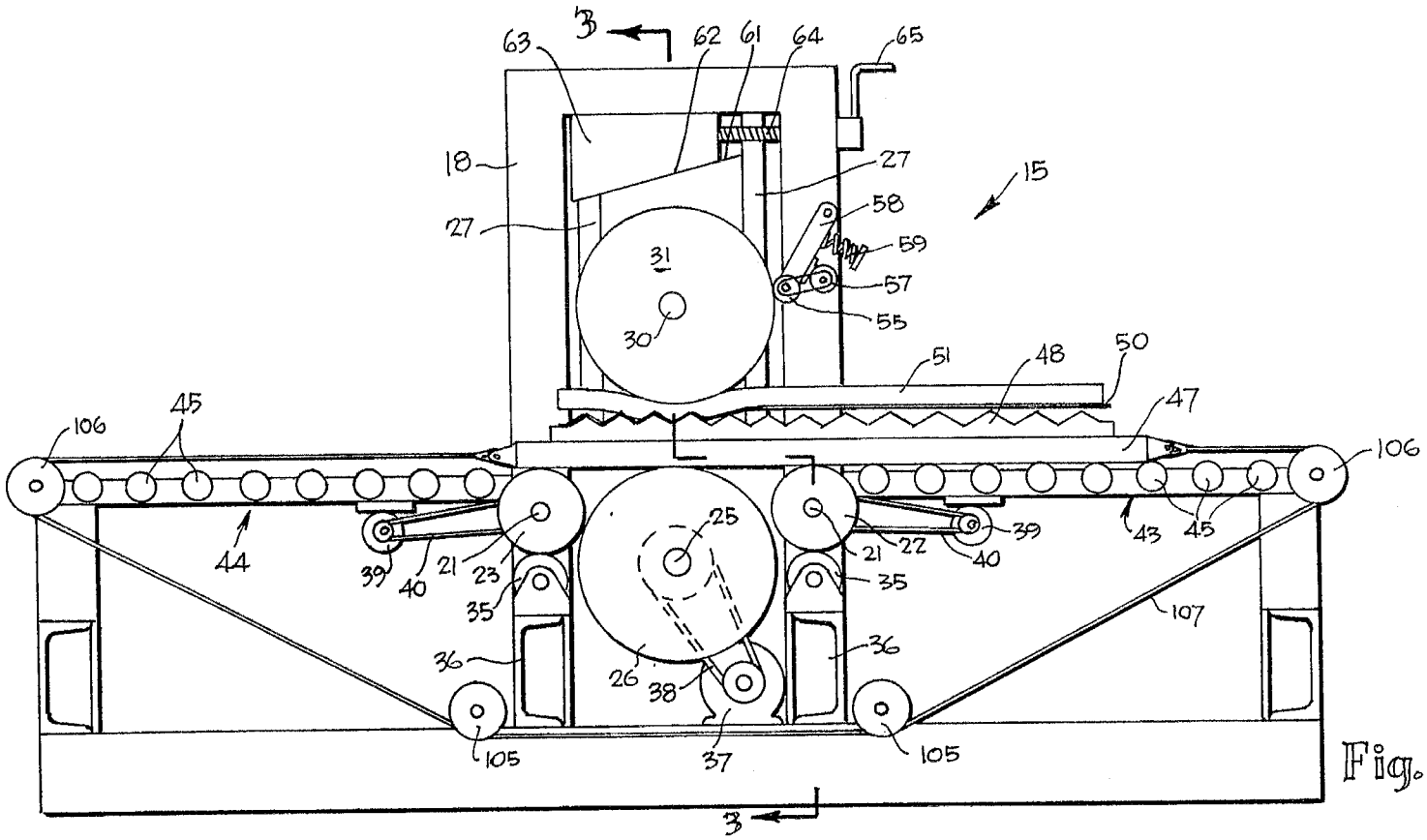
FIG. 1 is a diagrammatic elevational section of a machine for effecting a process of deforming a flat sheet metal workpiece.

The first embodiment is described with reference to FIGS. 1, 2 and 3 of the drawings which diagrammatically illustrate a machine for the metal forming process. The machine 15 comprises a frame 16 secured to bearers 17, the frame 16 including upstanding side frames 18 of inverted U-shape.

The upstanding side frames 18 contain bearings 20 in which are journalled shafts 21 of respective front and rear load rollers 22 and 23. The frame also incorporates side plates 24 which contain bearings (not shown) in which are journalled a shaft 25 of a lower pressing roller 26.

Two pairs of guides 27 guide bearing plates 29 for vertical movement, the bearing plates 29 having bearings 28 in which is journalled a shaft 30 of an upper pressing roller 31.

The front and rear load rollers 22 and 23 are relatively large but not as large as the pressing rollers 26 and 31.

Figure 3:
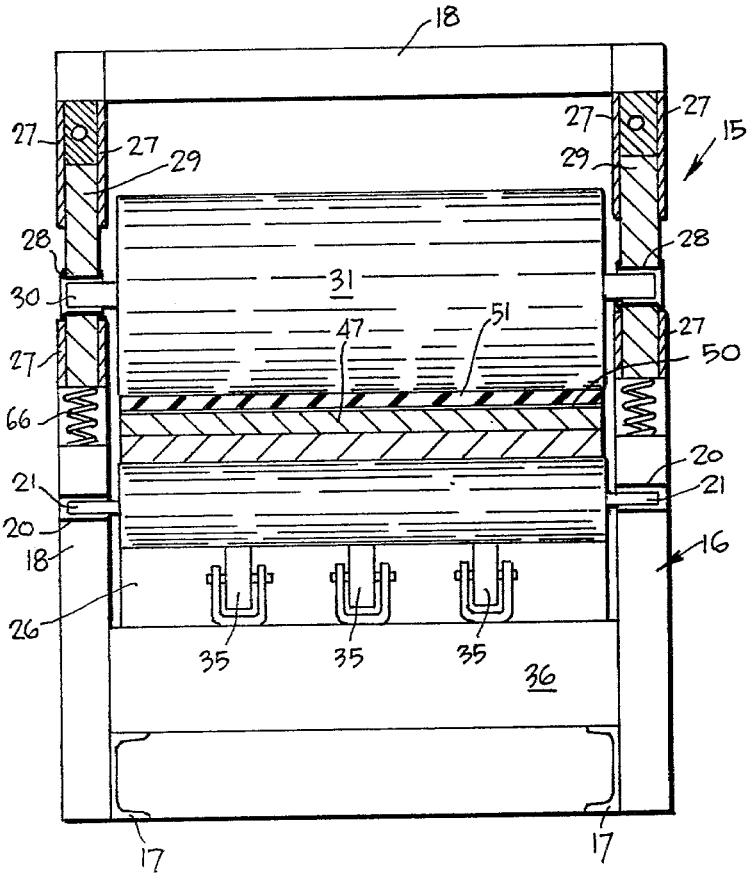
FIG. 3 is a diagrammatic cross-section taken on line 3—3 of FIG. 1.

However, they are load rollers, that is, capable of supporting loads in the order of 100 tonnes, and to inhibit deflection, they are supported intermediate their ends by support rollers 35 carried on transverse frames 36 as shown best in FIG. 3.

A geared motor 37 drives the lower pressing roller 26 through a drive chain 38, while motors 39 similarly drive the rollers 22 and 23 through the drive chains 40. To the front and rear of the load rollers 22 and 23 are respective roll cases 43 and 44 having small rollers 45 thereon which are capable of supporting loads in the order of one tonne.

The rolling surfaces of the roll case rollers 45, the load rollers 22 and 23 and the lower pressing roller 26 define a carriage support plane, and the rollers between them support a carriage 47 for movement between the nip of the rollers 26 and 31, and the carriage carries on it a die plate 48 having a pattern surface 49 (FIG. 2), and on the pattern surface 49 is positioned a flat sheet metal workpiece 50. Above the workpiece 50 is located an elastomeric slab 51, and the "sandwich" comprising the slab 51, the workpiece 50, the die plate 48 and the carriage 47 move together between the pressing rollers 26 and 31.

Figure 2:
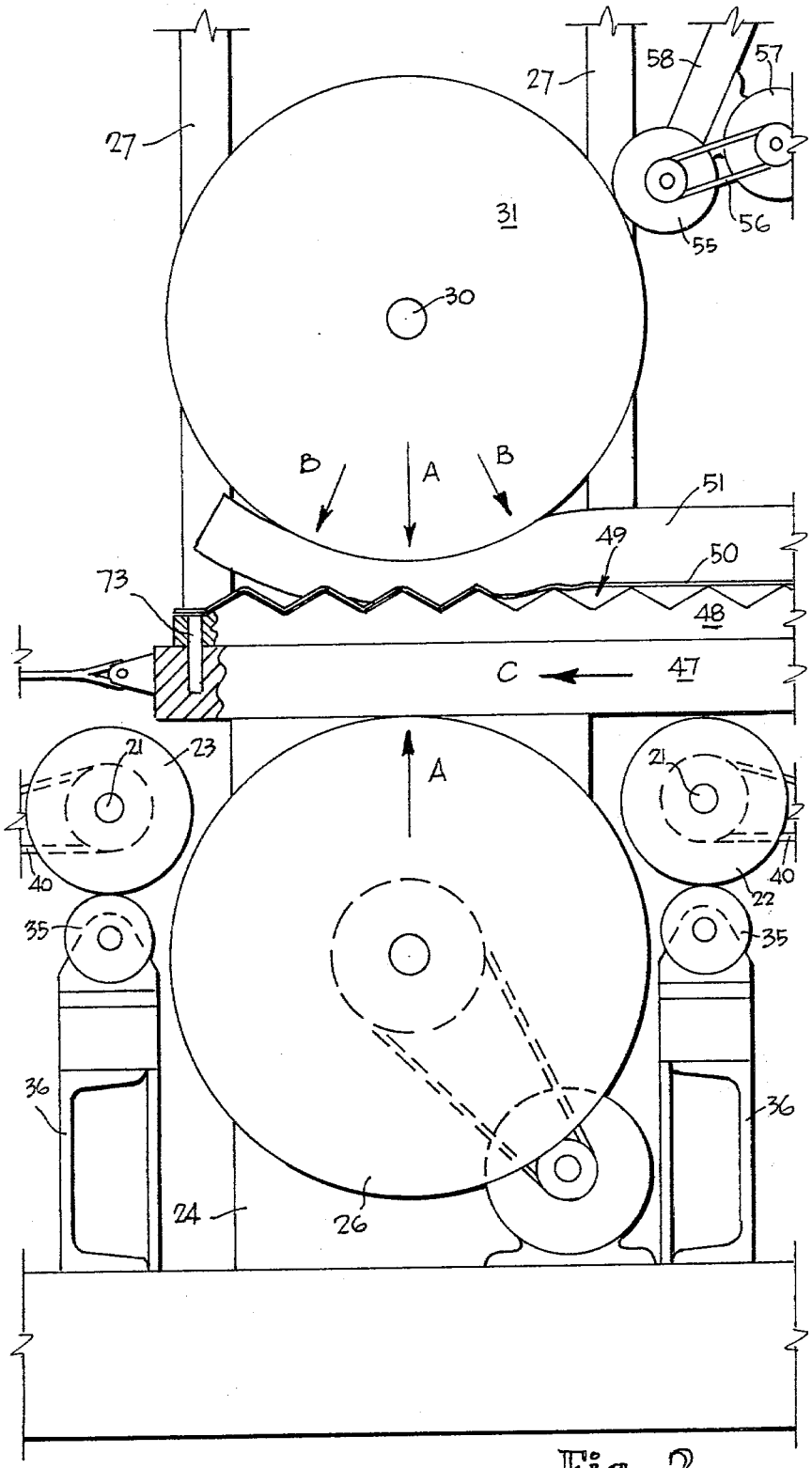
FIG. 2 is a diagrammatic fragmentary view of the roller assembly, drawn to an enlarged scale, and illustrating the resilient forces imposed by the elastomeric slab.

On FIG. 2, arrow A indicates the main pressure force which causes the slab 51 to deform the workpiece 50 so as to conform to the pattern surface 49. The arrows B indicate the secondary or resilient forces imparted by the elastomeric slab 51 to the die plate 48 and the carriage 47, which forces tend to curve the carriage and die plate. The material of the resilient slab 51 can vary, as also can its thickness, depending upon the amount of deformation or shearing of the workpiece 50. A suitable slab would be formed from rubber having a Shore A hardness of 60 and a thickness of one inch (25 mm).

When the slab 51 enters the nip of the rollers 26 and 31 its thickness is reduced and therefore its longitudinal speed is increased. Thus it is desirable (and in most instances essential) that the upper pressing roller 31 should be rotating, to ensure that the slab 51 is not displaced with respect to the workpiece 50. However the speed will vary as the slab moves forwardly in the direction of arrow C on FIG. 2 so that the loading end of the slab passes to the rear of the roller 31. Thus although the rollers 22, 23 and 26 may be driven by their respective motors at a constant speed, provision is made for varying the speed of roller 31, and accordingly roller 31 is driven by a friction wheel 55, through a drive chain 56 from a geared motor 57. The motor and wheel are carried on a pivoted arm 58, the arm being pivoted to a side frame 18 and spring loaded by a spring 59 such that slippage can take place between the wheel 55 and the rolling surface of the pressing roller 31.

There is a requirement for height adjustment of the upper pressing roller 31, and although this can be effected in a conventional manner by the use of screw threaded shafts, such an arrangement is undesirable because of the load imposed upon the threads. In this embodiment the upper ends of the bearing plates 29 (designated 61) slope and are engaged by a wedge surface 62 of a horizontally slidable wedge 63 which can be moved in ahorizontal direction by a screw 64 operated by a handle 65 to drive the bearing plates 29 downwardly. If the wedge is driven in the left hand direction of FIG. 1, the bearing plates 29 are urged upwardly by compression springs 66 (FIG. 3).

Figure 4:
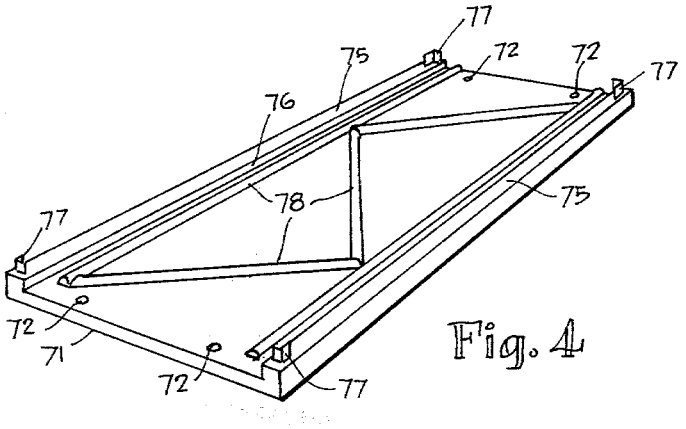
FIG. 4 is a perspective view of a die plate for forming a workpiece for use in a deep-web beam.
Figure 5:
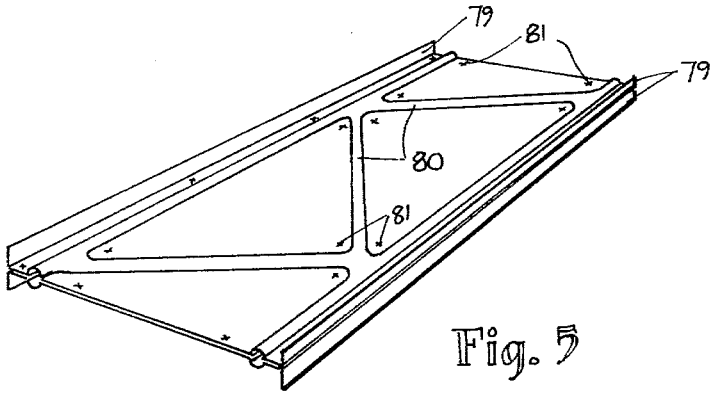
FIG. 5 is a perspective view of such a beam, comprising two workpieces joined back to back.

Reference is now made to the second embodiment of FIGS. 4 and 5. FIG. 4 illustrates a die plate 71 containing spigot apertures 72 for positioning over upstanding spigots 73 in the carriage 47 (FIG. 2). The die plate 71 merely needs to be located by positioning over the spigots 73, and this facility makes the die plate changeover quick and easy to effect. The die plate 71 has upstanding side portions 75 each defining a shallow vertical wall 76, and each carrying on it panel locating stops 77. The panel locating stops are arranged to engage side edges of a panel to be pressed. Ridges 78 form a pattern on the upper surface of die plate 71. When the panel is located across the upper portions 75 and passed through the machine 15, the panel has upwardly directed flanges 79 formed along its sides, and upwardly deformed embossments or swages. Two similar panels are subsequently spot welded together at spot weld localities 81 as shown in FIG. 5 to form a deep load bearing beam. The beam shown in FIG. 5 and the die plate shown in FIG. 4 are relatively short but can be quite long if required.

Figure 6:
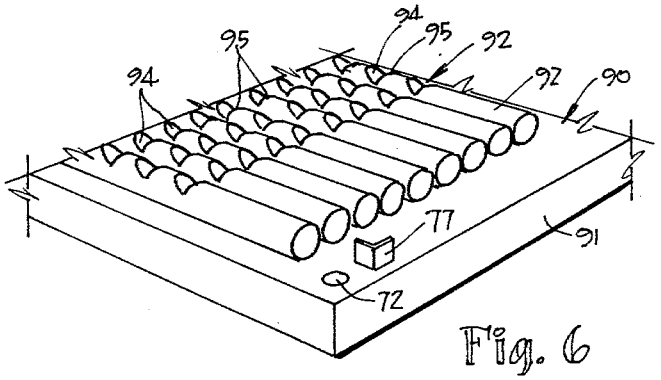
FIG. 6 is a fragmentary view of a die plate for forming a perforate embossed panel incorporating stiffening corrugations.
Figure 7:
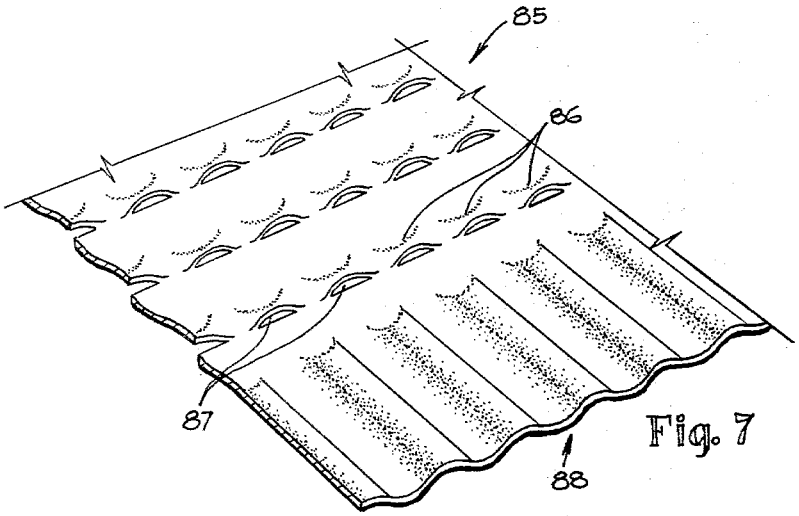
FIG. 7 is a fragmentary perspective view of such a panel.
Figure 8:
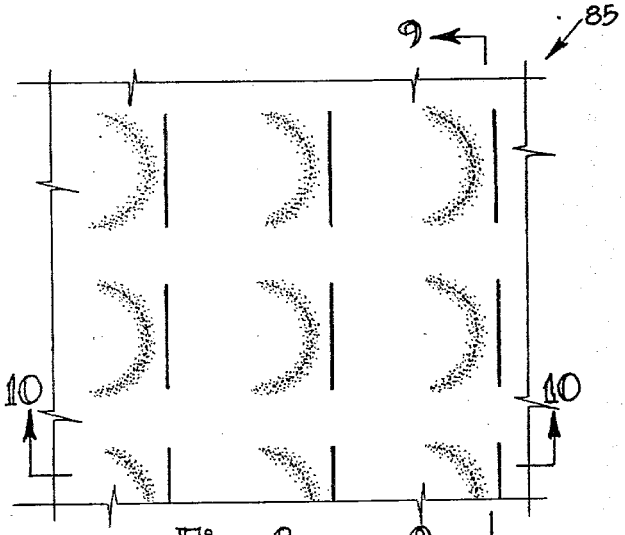
FIG. 8 is a fragmentary plan of FIG. 7.
Figure 9:
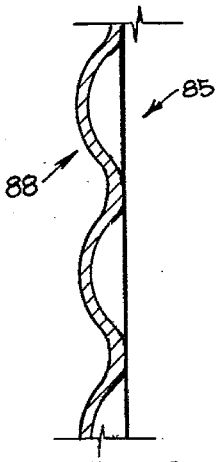
FIG. 9 is a fragmentary section taken on line 9—9 of FIG. 8.
Figure 10:
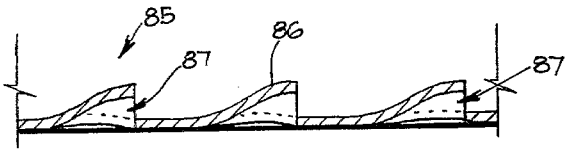
FIG. 10 is a fragmentary section taken on line 10—10 of FIG. 8.

FIGS. 6 through to 10 illustrate an embodiment for the production of a perforate panel 85 having embossments 86 and including perforations 87. The panel also includes corrugations 88 which are best shown in FIG. 9 and these impart a stiffness across the panel. The simplicity of the die requirement for this invention is seen from the die plate 90 of FIG. 6, which again has spigot apertures 72 and locating stops 77. The die plate 90 however is merely a flat sheet of steel 91 having a plurality of rods 92 welded to it, and the rods 92 having a series of slots 93 cut across them at spaced intervals, each slot 93 having a sloping wall 94 and a vertical wall 95.

Figure 11:
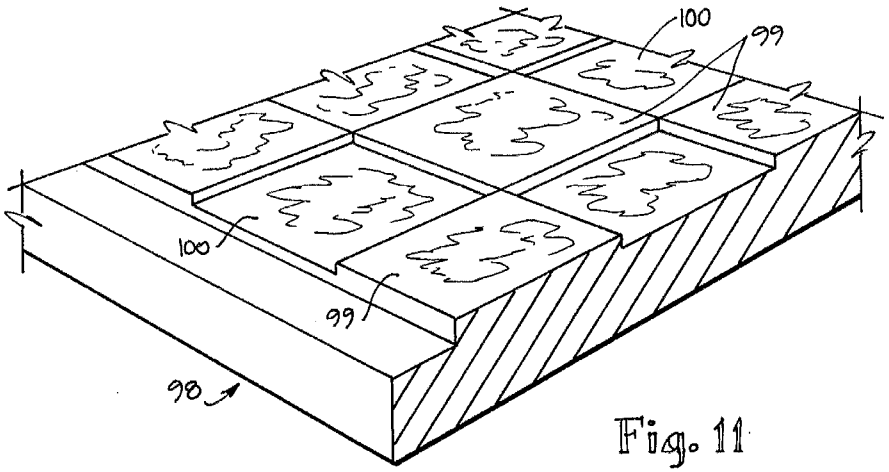
FIG. 11 is a fragmentary perspective view of a die plate used for embossing and shearing metal tiles.

The final embodiment of FIG. 11 illustrates a die plate 98 having a plurality of relatively high platforms 99 and relatively low platforms 100. Each platform has an upper surface with embossments thereon and with a workpiece supported on the die plate 98 is passed through the machine 15, the workpiece is sheared into a plurality of tiles and at the same time is embossed.

Initial movement and return of the carriage and die plate is effected by a winch 105, and pulleys 106 on the frame guide, a cable 107, the ends of which are secured to respective ends of the carriage, and the intermediate portion of which extends around the drum of winch 105.

In a further embodiment not herein illustrated, the machine is provided with pulleys on the loading and unloading side and with a return chute beneath the pulleys. The polymeric pad is in the form of an endless rubber or polyurethane belt which is positioned over the pulleys and supported fore and aft of the rollers by a support table. The pulleys may be freely rotatable or may be driven to synchronise with the peripheral speed of the rollers. In this instance, the workpiece is simply placed upon the rubber belt and the pattern plate upon the workpiece, and portion of the rubber belt then functions as the rubber pad. After the workpiece and pattern plate have been through the rollers, the workpiece is returned and the direction of travel of the rubber belt is reversed while the die plate and carriage are returned.

With the invention, the workpiece after having been formed can, in the case of a stainless steel plate, be spot welded to a backup plate to provide a composite laminate, for example, for use as a stainless steel floor. The machine can be associated with a regular roll forming machine so as to impart embossments to portion of a workpiece, for example, the facing portion of a metal fascia. The flanges can be formed at the edge of the embossments to be at right-angles to the general plane of the work sheet if this is required.

Although the above description has been limited to a flat sheet metal workpiece, the invention is also applicable to other deformable sheets, for example of certain plastics and elastomers (in their partly curved state), and of certain lignocellulose materials, such as plywood or cardboard.

I claim:

1. A metal forming process for deforming a workpiece to conform to a pattern on a surface of a die plate, comprising:

loading the die plate onto a carriage in a machine having a first pressing roller, a second pressing roller, a front load roller and a rear load roller respectively in front of and to the rear of, and both adjacent the second pressing roller and having their rolling surfaces cooperating with the rolling surface of the second pressing roller to define a carriage support plane, all said rollers having parallel axes of rotation, positioning the workpiece with one surface thereof contiguous with said pattern surface of the die plate, positioning a flat sided slab of elastomeric material with one surface thereof contiguous with an opposite surface of said workpiece, driving all said rollers simultaneously, and feeding the sandwich of said slab, workpiece, die plate, and carriage firstly over the front load roller, into the nip of the pressing rollers and then over the rear load roller, thereby supporting the carriage and die plate against deformation while at the same time deforming the workpiece on the pattern plate by plastic flow of the elastomeric slab.

2. A metal forming process according to claim 1 comprising driving the second pressing roller and the front and rear load rollers with motor and drive means at identical peripheral speeds, and driving said first pressing roller with motor and drive means which include slippage means whereby the peripheral speed of said first pressing roller is variable.

3. A metal forming process according to either claim 1 or claim 2 wherein said workpiece is a flat sheet metal workpiece, and so deforming the workpiece as to both emboss it and shear it.

4. A metal forming process according to claim 1 comprising operating a winch on the machine to effect said feeding of the sandwich of said slab, workpiece, die plate and carriage to said rollers, removing the workpiece from the die plate after said deforming of the workpiece, and returning said slab, die plate and carriage by operating said winch.

5. A metal forming process according to claim 4 wherein said slab is a sheet of rubber, comprising removing said slab from said sandwich before removing said workpiece, and replacing said slab on the die plate before returning said slab, die plate and carriage.

6. A metal forming process according to claim 1 wherein said pressing rollers are of relatively large diameter and said load rollers are of relatively small diameter, and further comprising supporting each of said load rollers intermediate its ends by support rollers while deforming the workpiece.

7. A machine useful for effecting a metal forming process comprising:

a frame, a plurality of pairs of transversely aligned bearings in the frame, a first pressing roller, a second pressing roller, a front load roller and a rear load roller all journalled for rotation in respective said pairs of bearings, said pressing rollers being of relatively large diameter and said load rollers being of relatively small diameter, the front load roller and the rear load roller being respectively to the front of and to the rear of, and both adjacent the second pressing roller and having their rolling surfaces co-operating with the rolling surface of the second pressing roller to define a carriage support plane, all said rollers having parallel axes of rotation, driving means coupled to respective said rollers and arranged to drive all said rollers simultaneously, a carriage on the machine, a die plate on the carriage having a pattern on a surface thereof, and a flat sided slab of elastomeric material co-operable with the die plate, and means for feeding said slab, die plate and carriage firstly over the front load roller, into the nip of the pressing rollers and then over the rear load roller.

8. A machine according to claim 7 wherein said driving means comprise a driving motor and a friction drive between the driving motor and said first pressing roller, arranged for slip such that said first pressing roller can rotate at variable speeds, said driving means comprising at least one driving motor and positive drive means coupling that motor or motors to respective other said rollers and arranged to drive those other rollers at constant peripheral speed.

9. A machine according to claim 7 wherein said frame comprises guides and bearing plates guided for vertical movement by the guides, the bearing plates containing a pair of said transversely aligned bearings, said first pressing roller having a shaft journalled for rotation in those bearings, and height adjustment means between the bearing plates and guides effective for adjusting the distance between the pressing rollers.

10. A machine according to claim 9 wherein said height adjustment means comprises a wedge between said frame and bearing plates, and means to move the wedge in a horizontal direction.

11. A machine according to claim 7 further comprising a plurality of support rollers each carried by the frame and each supporting a said load roller intermediate its ends.

12. A machine according to claim 7 wherein said means for feeding said slab, die plate and carriage comprise a pair of roll cases extending from each said load roller towards a respective end of said machine.

13. A machine according to claim 7 wherein said means for feeding said slab, die plate and carriage comprise a winch on the frame and a cable coupling the winch to the carriage.

* * * * *